United States Patent [19]

Rausing

[11] 4,391,385

[45] Jul. 5, 1983

[54] CLOSING ARRANGEMENT

[75] Inventor: Hans Rausing, Lund, Sweden

[73] Assignee: Tetra Pak Developpement SA, Pully, Switzerland

[21] Appl. No.: 294,440

[22] Filed: Aug. 20, 1981

[30] Foreign Application Priority Data

Aug. 20, 1980 [SE] Sweden ..... 8005840

[51] Int. Cl.[3] ..... B65D 39/00

[52] U.S. Cl. ..... 220/307; 220/269; 220/270

[58] Field of Search ..... 220/307, 339, 269, 270

[56] References Cited

U.S. PATENT DOCUMENTS 3,998,354 12/1976 Song ..... 220/307 X 4,280,634 7/1981 Wisenberger et al. ..... 220/307 X

*Primary Examiner*—George T. Hall

*Attorney, Agent, or Firm*—Burns, Doane, Swecker & Mathis

[57] ABSTRACT

The invention relates to a closing arrangements on cans and similar containers of the type which has at least one plane end wall of sheet metal with a hole punched out in the end wall. The cut surface of the said punched-out hole may be sealed effectively by a closing arrangement which is designed as a tubular plastic body with flanges projecting from the plastic body. The flanges embrace the edge zone of the hole when the closing arrangement is pressed into the hole, at the same time as the said cut edge of the end wall is pressed so as to form a seal against, or "is embedded in," the outside of the tubular plastic body.

15 Claims, 2 Drawing Figures

CLOSING ARRANGEMENT

BACKGROUND AND SUMMARY OF THE PRESENT INVENTION

The present invention relates to a closing arrangement for drums, canisters, cans and similar containers of the type which have at least one plane end wall of sheet metal with a hole punched out in the end wall.

Especially for cans intended to hold liquid contents it is customary to arrange a closable emptying opening in the cans, which in its simplest form may be constituted of a stopper introduced into an emptying hole, but which may also consist of a threaded flange arranged in the end wall of the can onto which can be screwed a lid so as to form a seal.

When contents, consisting e.g. of liquid foodstuffs, are packaged in cans or containers of metal, the contents must not come into direct contact with the metal, since m ions easily pass into the contents imparting a distinct metallic taste to the foodstuffs in question. This effect is particularly pronounced in cans and containers of sheet iron, and for this reason the sheet iron used for foodstuff packages must be coated with a protective layer of varnish or plastics. In general, cans and containers of the type referred to here are manufactured from sheet iron which has previously been varnished or coated, but if in containers manufactured from such a sheet pouring hole is punched out, the cut edge of the punched-out pouring hole has to be treated separately and provided with a coat of varnish or plastics or be protected in some other manner from coming into direct contact with the contents.

Such a separate treatment of the cut edge of the pouring hole is possible to perform, but it is relatively expensive, and if a closing arrangement in accordance with the invention is used, the need for a separate treatment of the cut edge of the pouring hole is eliminated at the same time as a tight, readily openable closing arrangement is provided in one of the metal end walls of the container.

The closing arrangement of the present invention comprises a tubular plastic body which can be pressed into a hole punched out in the metal end wall of the container. The tubular plastic body is provided with annular flanges, arranged preferably in a parallel plane, which embrace the edge zone of the said hole in such a manner that one of the said flanges rests against one side of the end wall and the other flange rests against the opposite side of the end wall. The cut edge of the hole along the whole of its periphery rests so as to form a seal against, or is embedded in, the surface layer of the tubular plastic body, and the tubular body, whose inner tube channel is adapted so as to constitute an emptying channel for the contents present in the container, is sealed on its top part by means of a cover disc attached to the top mouth of the tube channel along an easily breakable joint.

BRIEF DESCRIPTION OF THE DRAWINGS

The invention will be described in the following with reference to the enclosed drawing wherein.

DETAILED DESCRIPTION OF THE PREFERRED EMBODIMENTS

Figure 1:
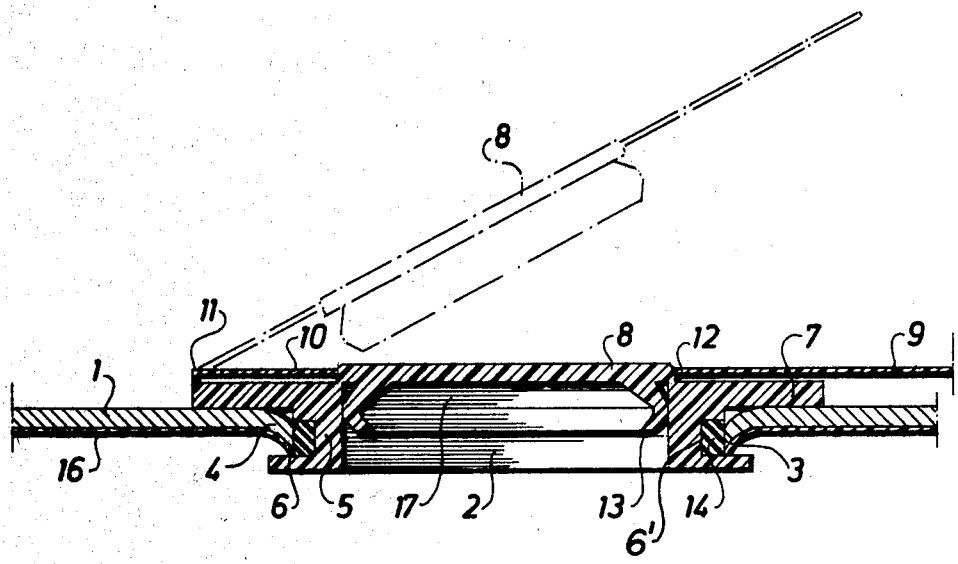
FIG. 1 is a cross-sectional view of a container end wall with a closing arrangement in accordance with the present invention and FIG. 2 is a cross-sectional view of a modified closing arrangement in accordance with the present invention.

In FIG. 1 the end wall of the container of sheet metal, in particular of sheet iron, is designated 1, and the said metal end wall 1 is provided at least on the side facing towards the inside of the container with a protective coating 16 of varnish or plastics.

In the end wall 1 a preferably circular hole 2 is punched out, and on punching out of the said hole an unprotected cut metal edge 3 is formed around the periphery of the hole. In the punching out of the hole 2 shown in FIG. 1, the sheet material in the end wall 11, at the same time, has been slightly folded downwards-inwards in an area around the hole 2 so that a somewhat inwardly directed lip 4 is formed.

A closing arrangement is pressed into the hole 2 which is manufactured preferably from plastic material e.g. polyethylene/polypropylene or the like and the said closing arrangement is made preferably by injection moulding. The closing arrangement consists of a short tubular body 5 whose outside diameter substantially corresponds, or slightly exceeds, the diameter of the hole 2. The tubular body 5 is provided in its upper part with a circular flange 7 which has a substantially larger outside diameter than the tubular body 5, and the tubular body 5 is provided in its lower part with an annular flange 6 which has a slightly larger outside diameter than the tubular body 5.

The hole 17 in the tubular body 5 is intended to form an emptying channel for the contents enclosed in the container. When the container is closed, the said emptying channel 17 is covered over by a cover plate 8 which along a zone 12 closed in itself is attached to the top part of the tubular body 5 along a thin, easily breakable plastic zone. The cover plate 8 in turn is connected on the one hand to a relatively thin strip 10 of plastic material which at the point 11 is connected to the outer part of the flange 7, and on the other hand to a gripping tag 9. The plastic material in the strip 10 and at the connecting point 11 is so thin that after breaking of the plastic zone 12 the cover disc can easily be removed from the emptying channel 17 by being torn along the connecting point 11. To make the arrangement reclosable after the plastic zone has been broken up, the underside of the cover strip 8 may be provided with an annular, flexible, stopperlike bulge 13 whose outside diameter is normally a little larger than the diameter of the emptying channel 17, the stopperlike part 13 being so flexible, however, that it can readily be introduced into the channel 17 and retained in the same owing to the spring effect which is exercized by the part 13 against the inside of the emptying channel.

To protect the cut metal edge 3 from coming into contact with the contents, the cut edge is pressed, in accordance with the invention, against the outside of the annular part 5, and since the plastic material is softer than the metal material in the end wall 1, and the tubular plastic body 5 is slightly overdimensioned in relation to the punched-out hole 2, the cut edge 3 will be embedded in the plastic material and will be protected by the same.

To ensure further that the cut edge 3 is protected against contact with the contents, an annular recess 6' may be provided in the tubular body 5 which is filled with a softer plastic or rubberlike material 14 so as to ensure a further "embedding" of the cut edge 3.

The said softer material 14 may be constituted e.g. of a so-called "sealing compound" cast onto the annular body 5 or else of a sealing ring of a rubberlike material.

Whether the softer sealing material 14 is required to ensure "embedding" of the cut edge 3 must be decided in each individual case and will depend, among other things, on the hardness of the material in the annular plastic body 5.

The closing arrangement in accordance with the invention is injection-moulded advantageously in one piece with the exception of the possible insert 14 which has to be applied separately. The closing arrangement in accordance with FIG. 1 can be applied advantageously to the hole 2, punched out of the end wall 1, before the end wall 1 has been lock-seamed onto the container.

The closing arrangement is opened in such a manner that the gripping tag 9 is pulled upwards with a force sufficient to break the readily breakable joint 12 between the cover disc 8 and the tubular body 5. The cover disc is then torn away from the tubular body 5 and is raised up to the position shown in broken lines in FIG. 1.

The emptying channel 17 has now been laid open and the contents of the container can be poured off, whereupon the channel can be reclosed by pressing the stopperlike part 13, which is joined to the cover disc 8, into the emptying channel 17.

Owing to the end wall around the hole 2 having a lip-shaped downward-bend 4 of end wall material, the edge zone around the hole 2 of the end wall 1 can be fitted in between the flanges 6 and 7, which are so dimensioned that the distance between them corresponds to, or is slightly less, than the downward-bend of the lip 4, so that the edge zone of the end wall 1 around the hole 2 will become clamped between the flanges 6 and 7 and fixed in this clamped position, with the cut edge 3 pressed against the outer part of the tubular plastic body 5 or alternatively against the soft insert 6.

Figure 2:
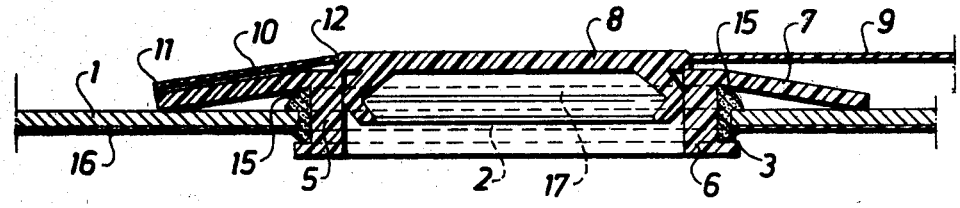

An alternative embodiment of the closing arrangement is shown in FIG. 2 and, for the sake of clarity, substantially the same reference numerals have been used for the different details in FIGS. 1 and 2.

In FIG. 2 is shown how the end wall 1 with its protective coating 16 has a punched-out circular hole 2. However, the punching out is done in such a manner that the edge zone around the hole 2 is not folded down to an appreciable extent.

Similarly to what has been described earlier, the closing arrangement comprises a tubular body 5 which is provided with flanges 6 and 7, the flange 7, however, in the case shown here being in the shape of a "cup spring" whose outer part, when the closing arrangement has been put in position in the end wall, rests against the outer surface of the end wall 1 for the purpose of fixing the closing arrangement in the end wall 1 by pressing the flange 6, by means of the spring force of the flange 7, against the inside of the end wall 1. For the rest, the closing arrangement is designed in the same manner as that shown in FIG. 1, but instead of a soft insert 14 in the outer part of the tubular plastic stopper 5 a curable mass 15 has been provided between the flanges 6 and 7, which curable mass will enclose the cut edge 3 of the hole 2 when the closing arrangement is introduced into the punched-out hole 2.

After introduction of the closing arrangement into the punched-out hole 2, the mass 15 is cured e.g. through the effect of heat or through the addition of a curing agent, so that the cut edge 3, after completed curing of the mass 15, on the one hand is effectively embedded in and protected by the cured mass, and on the other hand is effectively fixed to the closing arrangement. The closing arrangement shown in FIG. 2 is opened in the same manner as that described earlier in connection with the embodiment according to FIG. 1.

In accordance with the object of the invention, the cut edge of the hole punched out in a sheet metal lid is to be effectively protected from contact with the contents in the container or drum whereof the lid constitutes a part. This technical problem is solved in accordance with the invention in that the cut edge is forced into tight contact with, and is "embedded in," the plastic material in a closing arrangement applied to the punched-out hole. The closing arrangement can be manufactured of material that is sufficiently soft for obtaining a satisfactory sealing and "embedding" of the cut edge or else the closing arrangement can be provided in the area of the said cut edge with a softer insert or a softer material so as to facilitate the protection of the cut edge against contact with the contents. It has been found that a closing arrangement in accordance with the examples described here functions well, and that the closing arrangement is inexpensive to manufacture at the same time as it forms an effective sealing off of the cut edge of the punched-out hole.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

What is claimed is:

1. A closing arrangement for containers which have at least one plane end wall and an aperture therein, comprising:

a unitary closing body insertable into the aperture, said closing body including:

flange means for retaining said closing body in the aperture, a container-emptying channel in said closing body, and cover means sealed to said closing body for closing said channel in said body; and a separate seal means located on an outer periphery of said closing body for sealing against an edge of the aperture, said seal means including an annular layer of a material softer than said body in which material said edge of the aperture becomes embedded.

2. The closing arrangement of claim 1 wherein the end wall is coated on an inner surface and wherein said seal means prevents any contact between an uncoated portion of the end wall around said aperture and a fluid held by the container.

3. The closing arrangement of claim 1 wherein the seal means includes an outer surface of said body such that said edge of said aperture becomes embedded in said outer surface because said body is somewhat larger in diameter than said aperture.

4. The closing arrangement of claim 1 wherein said annular layer of material is a sealing ring of a rubber-like material in which material said edge of the aperture becomes embedded.

5. The closing arrangement of claim 1 wherein said annular layer of material is a sealing compound in which compound said edge of the aperture becomes embedded.

6. A closing arrangement for containers which have at least one plane end wall and an aperture therein, comprising:

a unitary closing body insertable into the aperture, said closing body including:

flange means for retaining said closing body in the aperture, a container-emptying channel in said closing body, and cover means sealed to said closing body for closing said channel in said body; and a separate seal means located on an outer periphery of said closing body for sealing against an edge of the aperture, said seal means including an annular layer of a curable plastic mass which is hardened after said closing body has been inserted in the end wall so that said edge of the aperture becomes embedded in said hardened plastic mass.

7. The closing arrangement of claim 1 wherein said cover means includes a disc-like upper portion joined to a stopper-like lower portion, said disc-like upper portion being initially sealed to an upper surface of said body along an easily breakable joint and said stopper-like lower portion flexing against an inner wall of said channel in a sealing engagement.

8. The closing arrangement of claim 7 wherein said cover means can be torn away from said body to open the container and can be used to reclose the container after it has been opened.

9. The closing arrangement of claim 7 further comprising a gripping tag attached to said disc-like upper portion, said cover means being able to be pulled by said gripping tag to tear said cover means from said closing body.

10. The closing arrangement of claim 1 wherein said flange means includes:

a first annular retaining flange of somewhat larger size than the aperture, abutting an inner surface of the end wall; and a second annular retaining flange of substantially larger size than the aperture, abutting an outer surface of the end wall.

11. The closing arrangement of claim 10 wherein said second annular flange is downwardly angled to act in a spring-like manner and thereby press said first annular flange against the inner surface of the end wall.

12. The closing arrangement of claim 1 or 6 wherein said seal means is located in an annular recess in said closing body.

13. A closure device for cans of the type having at least one metallic end wall with a protective coating on an inner surface thereof and with an aperture therein, comprising:

a one-piece tubular closing body insertable into said aperture, said body including:

a first annular retaining flange, of somewhat larger size than the aperture, abutting an inner surface of the metallic end wall, a second annular retaining flange, of substantially larger size than the aperture, abutting an outer surface of the metallic end wall, a channel in said body for use in emptying the container, and a cover disc closing said channel and initially sealed to an upper surface of said body along an easily breakable joint wherein said cover disc can be torn away from said body to open the container and can be used to reclose the container; and a separate sealing means located on an outer periphery of said body between said flanges to prevent any leakage between the aperture and said body, said sealing means including a sealing compound, said sealing compound being located in an annular recess in said outer periphery of said closing body such that an edge of said aperture becomes embedded in said sealing compound.

14. A closure device for cans of the type having at least one metallic end wall with a protective coating on an inner surface thereof and with an aperture therein, comprising:

a one-piece tubular closing body insertable into said aperture, said body including:

a first annular retaining flange, of somewhat larger size than the aperture, abutting an inner surface of the metallic end wall, a second annular retaining flange, of substantially larger size than the aperture, abutting an outer surface of the metallic end wall, a channel in said body for use in emptying the container, and a cover disc closing said channel and initially sealed to an upper surface of said body along an easily breakable joint wherein said cover disc can be torn away from said body to open the container and can be used to reclose the container; and a separate sealing means located on an outer periphery of said body between said flanges to prevent any leakage between the aperture and said body, said sealing means including a curable plastic mass which is cured after said body is inserted into the aperture such that an edge of said aperture becomes embedded in said cured mass.

15. The closure device of claim 12 wherein said seal means prevents any contact between a fluid contained by the can and the metallic end wall to prevent any metal ions from the end wall from passing into said fluid.

* * * * *